US006364730B1

(12) United States Patent
Jaskie et al.

(10) Patent No.: US 6,364,730 B1
(45) Date of Patent: Apr. 2, 2002

(54) METHOD FOR FABRICATING A FIELD EMISSION DEVICE AND METHOD FOR THE OPERATION THEREOF

(75) Inventors: James E. Jaskie; Albert Alec Talin, both of Scottsdale; Paul VonAllmen, Mesa; Bernard F. Coll, Fountain Hills, all of AZ (US); Kathleen Anne Tobin, San Antonio, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/484,930

(22) Filed: Jan. 18, 2000

(51) Int. Cl.[7] ..... H01J 9/02
(52) U.S. Cl. ..... 445/24; 313/309; 345/75.2
(58) Field of Search ..... 445/24, 6; 313/309; 315/169.3; 345/75.1, 75.2

(56) References Cited

U.S. PATENT DOCUMENTS 5,189,341 A 2/1993 Itoh et al.
5,209,687 A 5/1993 Konishi
5,587,720 A 12/1996 Fukuta et al.
5,610,478 A 3/1997 Kato et al.
5,639,356 A 6/1997 Levine
5,825,134 A 10/1998 Ito
5,865,657 A * 2/1999 Haven et al. ..... 445/24
5,969,467 A 10/1999 Matsuno
6,005,335 A * 12/1999 Potter ..... 313/309
6,042,441 A * 3/2000 Konuma ..... 445/6

* cited by examiner

*Primary Examiner*—Kenneth J. Ramsey
(74) *Attorney, Agent, or Firm*—Kevin D. Wills; Frank J. Bogacz

(57) ABSTRACT

A method for operating a field emission device (100) having an electron emitter (115) includes the steps of providing an emitter-enhancing electrode (117) proximate to electron emitter (115), causing emitter-enhancing electrode (117) to emit electrons, and causing the electrons emitted by emitter-enhancing electrode (117) to be received by electron emitter (115). A method for fabricating a field emission device (100) includes the steps of forming a layer (126) of dielectric material, forming emitter-enhancing electrode (117) on layer (126) of dielectric material, forming an enhanced-emission structure (131) in emitter-enhancing electrode (117), removing a portion of layer (126) of dielectric material proximate to enhanced-emission structure (131) to form a well (114, 158), and forming electron emitter (115) within well (114, 158).

15 Claims, 4 Drawing Sheets

METHOD FOR FABRICATING A FIELD EMISSION DEVICE AND METHOD FOR THE OPERATION THEREOF

REFERENCE TO RELATED APPLICATION

Related subject matter is disclosed in a U.S. patent application entitled "Field Emission Device Having an Emitter-Enhancing Electrode," filed on even date herewith, and assigned to the same assignee.

FIELD OF THE INVENTION

The present invention relates, in general, to methods for fabricating and operating field emission devices, and, more particularly, to methods for conditioning and cleaning electron emitters in a field emission device.

BACKGROUND OF THE INVENTION

It is known in the art that the electron emitters of a field emission device can become contaminated during the operation of the field emission device. The contaminated emissive surfaces typically have electron emission properties that are inferior to those of the initial, uncontaminated emissive surfaces. Several schemes have been proposed for conditioning the electron emitters and removing contaminants from the emissive surfaces thereof.

For example, it is known in the art to decontaminate or condition the emissive surfaces by scrubbing them with an electron beam provided by the electron emitter structures. An example of this scheme is described in U.S. Pat. No. 5,587,720, entitled "Field Emitter Array and Cleaning Method of the Same" by Fukuta et al. However, this type of scheme can result in inefficient cleaning due to the electronic bombardment of surfaces other than the electron emissive surfaces, which can result in undesirable desorption of contaminants.

It is also known in the art to decontaminate or condition the emissive surfaces by applying a high, positive voltage pulse to the gate extraction electrode. This scheme is described in U.S. Pat. No. 5,639,356, entitled "Field Emission Device High Voltage Pulse System and Method" by Levine. Levine teaches that the high, positive voltage pulse increases the electric field at the emissive surfaces, thereby decreasing the adhesion energy of absorbates and facilitating the desorption of contaminants. However, this method does not provide the conditioning benefits realized from an electron scrubbing technique, wherein the emissive surfaces are bombarded with electrons.

Accordingly, there exists a need for a method for enhancing electron emission in a field emission device, which overcomes at least these shortcomings of the prior art.

BRIEF DESCRIPTION OF THE DRAWINGS

Referring to the drawings.

Figure 1:
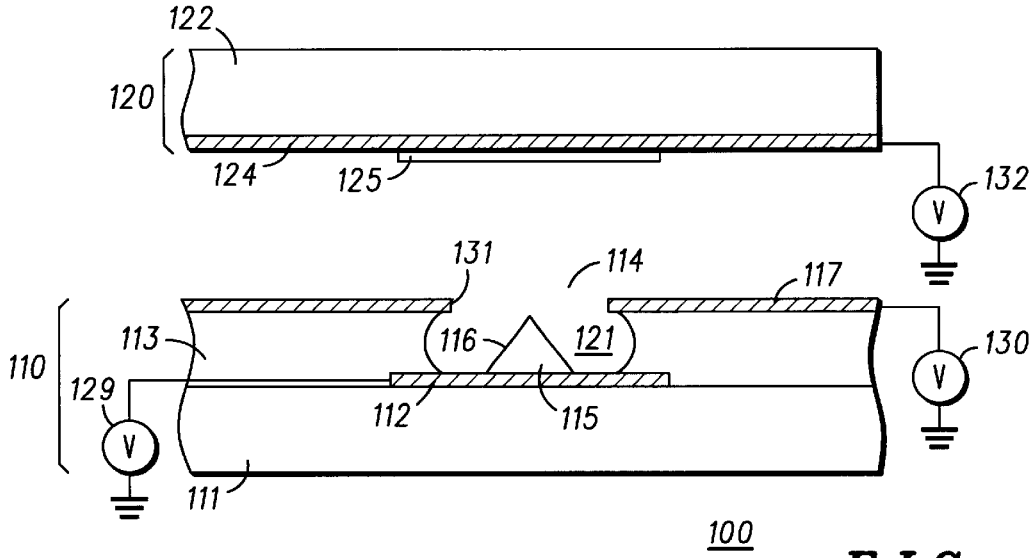
FIG. 1 is a cross-sectional view illustrating an embodiment of a field emission device made in accordance with the method of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a method for fabricating a field emission device and a method for its operation. In accordance with the invention, the method for operating a field emission device includes the steps of causing an emitter-enhancing electrode to emit electrons and causing the electrons to be received by an electron emitter. The method of the invention provides the benefits of cleaning, conditioning, and sharpening of the electron emitter. The method of the invention also ameliorates outgassing of contaminants from non-emissive surfaces. These benefits improve the emission characteristics and increase the life of the device.

A method for fabricating a field emission device in accordance with the invention includes the step of forming a mask layer on an emitter-enhancing electrode, so that the mask layer defines an opening disposed within an opening defined by the emitter-enhancing electrode. The method of fabrication of the invention allows the formation of a conical electron emitter, even though the opening of the emitter-enhancing electrode is not circular. This is due to the fact that the deposition of the electron emitter occurs through the opening defined by the mask layer, rather than the opening defined by the emitter-enhancing electrode. Thus, the opening of the emitter-enhancing electrode can define angles, which are not also created in the cross-section of the electron emitter. By eliminating unnecessary sharp features in the electron emitter, undesired electron emission can be avoided, and the device can be made more efficient.

Another method for fabricating a field emission device in accordance with the invention includes the step of forming a protective layer on an enhanced-emission structure of an electron-emissive layer. The protective layer provides the benefit of maintaining the structural integrity of the enhanced-emission structure throughout subsequent steps, such as the step of forming an electron emitter. For example, the enhanced-emission structure may be realized by making the electron-emissive layer very thin, and the protective layer can be used to protect the thin layer from breakage during subsequent fabrication steps.

Although the drawings illustrate display devices, the scope of the invention is not limited to displays. Rather, the invention can be practiced in the fabrication and operation of other types of field emission devices, such as switches, amplifiers, and the like. Furthermore, the scope of the invention is not limited to conically-shaped or symmetrical emitters. For example, the invention can be practiced in the fabrication and operation of devices having surface emitters, edge emitters, or emitters that do not require emitter wells.

FIG. 1 is a cross-sectional view illustrating an embodiment of a field emission device (FED) 100 made in accordance with the method of the invention. As illustrated in FIG. 1, FED 100 includes a cathode plate 110 and an anode plate 120. Cathode plate 110 includes a substrate 111, which can be made from glass, silicon, and the like. A cathode 112 is disposed upon substrate 111. Cathode 112 is connected to a first voltage source 129. A dielectric layer 113 is disposed upon cathode 112, and further defines an emitter well 114.

An electron emitter 115, which is preferably a Spindt tip, is disposed within emitter well 114. Electron emitter 115 has an electron-emissive tip 116, from which electrons can be emitted by applying a suitable electric field thereto. Methods for fabricating cathode plates for matrix-addressable FED's are known to one of ordinary skill in the art. Anode plate 120 is disposed to receive electrons emitted by electron emitter 115.

In accordance with the method of the invention, an emitter-enhancing electrode 117 is disposed on dielectric layer 113 and is connected to a second voltage source 130. Emitter-enhancing electrode 117 has an enhanced-emission structure 131, which is proximate to electron-emissive tip 116. In the embodiment of FIG. 1, the distance between enhanced-emission structure 131 and electron-emissive tip 116 is about 500 angstroms. Emitter-enhancing electrode 117 further defines an opening 121, which is in communication with emitter well 114.

Emitter-enhancing electrode 117 of FIG. 1 serves two functions. First, it is useful for applying an electric field for extracting electrons from electron emitter 115. Second, it is useful for supplying electrons for cleaning and conditioning electron emitter 115.

In general, enhanced-emission structure 131 of emitter-enhancing electrode 117 facilitates electron emission from emitter-enhancing electrode 117 during a conditioning mode of operation. Enhanced-emission structure 131 is a structure that is not found in prior art gate extraction electrodes. Enhanced-emission structure 131 is useful for realizing enhanced electron emission, as compared to electron emission that could be realized from a prior art gate extraction electrode.

Further, emitter-enhancing electrode 117 is positioned so that, when it is caused to emit electrons, all or a substantial portion of the electrons are received by electron emitter 115. Preferably, all or a substantial portion of the electrons are received by the emissive portion of electron emitter 115. In the embodiment of FIG. 1, emitter-enhancing electrode 117 circumscribes electron emitter 115.

Anode plate 120 includes a transparent substrate 122 made from, for example, glass. An anode 124 is disposed on transparent substrate 122. Anode 124 is preferably made from a transparent conductive material, such as indium tin oxide. Anode 124 is connected to a third voltage source 132. Third voltage source 132 is useful for applying an anode voltage to anode 124.

A phosphor 125 is disposed upon anode 124. Phosphor 125 is cathodoluminescent. Thus, phosphor 125 emits light upon activation by electrons. Methods for fabricating anode plates for matrix-addressable FED's are known to one of ordinary skill in the art.

In general, a method for operating FED 100 in accordance with the invention includes the steps of providing emitter-enhancing electrode 117 proximate to electron emitter 115, causing emitter-enhancing electrode 117 to emit electrons, and causing the electrons emitted by emitter-enhancing electrode 117 to be received by electron emitter 115. Preferably, the electrons emitted by emitter-enhancing electrode 117 are received by electron-emissive tip 116 of electron emitter 115. Because emitter-enhancing electrode 117 is proximate to electron emitter 115, electrons can easily be directed toward electron emitter 115, and can avoid bombarding other surfaces. This provides the benefit of reduced outgassing of contaminants from the other, non-emissive surfaces within FED 100.

Figure 2:
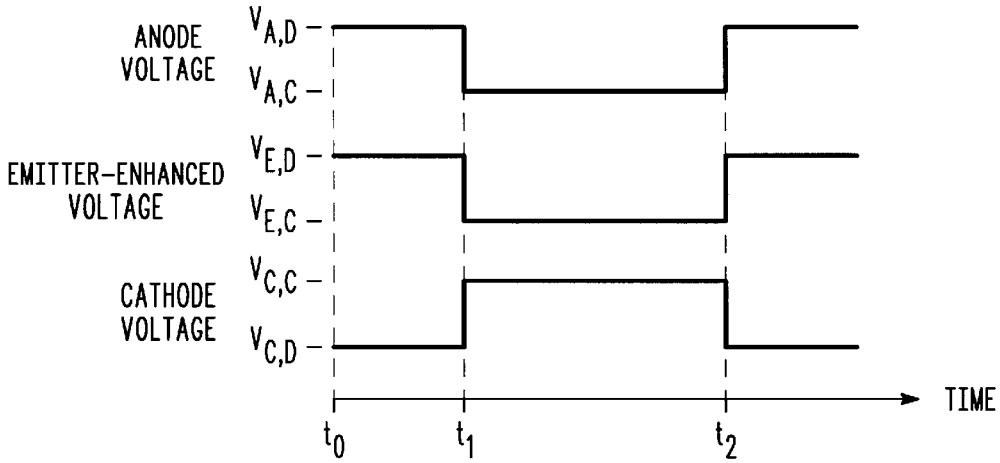
FIG. 2 is a timing diagram illustrating a method for operating a field emission device, in accordance with the method of the invention.

FIG. 2 is a timing diagram illustrating a method for operating FED 100, in accordance with the method of the invention. Represented in FIG. 2 are the anode voltage, $V_A$, which is applied to anode 124; the emitter-enhancer voltage, $V_E$, which is applied to emitter-enhancing electrode 117; and the cathode voltage, $V_C$, which is applied to cathode 112 and electron emitter 115.

FED 100 can be operated in a display mode and in a conditioning mode. The display mode of operation is represented in FIG. 2 by the portions of the graphs between times $t_0$ and $t_1$ and after time $t_2$. The conditioning mode of operation is represented in FIG. 2 by the portions of the graphs between times $t_1$ and $t_2$. In accordance with the method of the invention, during the display mode of operation, electron emitter 115 is caused to emit electrons, and, during the conditioning mode of operation, emitter-enhancing electrode 117 is caused to emit electrons.

When FED 100 is operated in the display mode, an image is produced at anode plate 120. The image is produced by causing electron emitter 115 to emit electrons, which are attracted toward and received by phosphor 125 and anode 124. Further, during the display mode, emitter-enhancing electrode 117 functions as an extraction electrode, which is used to extract electrons from electron emitter 115.

The emitter-enhancer voltage during the display mode, $V_{E,D}$, the anode voltage during the display mode, $V_{A,D}$, and the cathode voltage during the display mode, $V_{C,D}$, are selected to cause electron emission from electron emitter 115 and to attract the electrons toward anode 124. Preferably, $V_{E,D}$ is equal to about 100 volts, while $V_{C,D}$ is maintained at about ground potential, and $V_{A,D}$ is equal to a voltage within a range of 1000–5000 volts.

In accordance with the method of the invention, the emitter-enhancer voltage during the conditioning mode, $V_{E,C}$, the anode voltage during the conditioning mode, $V_{A,C}$, and the cathode voltage during the conditioning mode, $V_{C,C}$, are selected to cause electron emission from emitter-enhancing electrode 117 and to attract the electrons toward electron emitter 115. Thus, during the conditioning mode of operation, emitter-enhancing electrode 117 does not function as an extraction electrode for extracting electrons from electron emitter 115. Rather, emitter-enhancing electrode 117 is caused to emit electrons toward electron-emissive emissive tip 116 of electron emitter 115.

This can be achieved by applying to emitter-enhancing electrode 117 a potential, which is sufficiently less than the potential at electron emitter 115 to cause emitter-enhancing electrode 117 to emit electrons. Further during the conditioning mode of operation of FED 100, the potential at anode 124 can be reduced to a value sufficient to prevent attraction toward anode 124 of the electrons that are emitted by emitter-enhancing electrode 117. Preferably, during the conditioning mode of operation, $V_{E,C}$ is equal to a voltage of about ground potential; $V_{A,C}$ is equal to a voltage of about ground potential; and $V_{C,C}$ is equal to about 100 volts.

The electric field, which is established during the conditioning mode of operation, can generate a mechanical force at electron emitter 115, which is useful for sharpening electron-emissive tip 116. The electric field also causes field ionizing and desorption of contaminants at electron-emissive tip 116.

In a preferred example of the method of the invention, the step of causing emitter-enhancing electrode 117 to emit electrons is performed while the temperature of electron emitter 115 is elevated. Preferably, the elevated temperature is due to electron emission from electron emitter 115. That is, when electron emitter 115 emits electrons during the display mode of operation, its temperature is increased to an elevated value. While its temperature is at the elevated value, electron emitter 115 is bombarded and scrubbed with electrons from emitter-enhancing electrode 117. The increased temperature facilitates desorption of contaminants from electron emitter 115 during the conditioning mode of operation.

Figure 3:
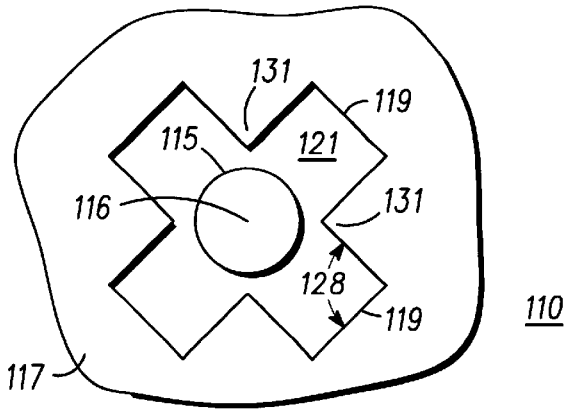
FIG. 3 is a top plan view of a cathode plate of the field emission device in FIG. 1, made in accordance with the method of the invention.

FIG. 3 is a top plan view of cathode plate 110 of FED 100 of FIG. 1, made in accordance with the method of the invention. In the embodiment of FIG. 3, emitter-enhancing electrode 117 has a distal edge 119, which is coextensive with enhanced emission structure 131. In order to enhance the local electric field at enhanced-emission structure 131 during the conditioning mode of operation, the distance between distal edge 119 and electron-emissive tip 116 is made greater than the distance between enhanced-emission structure 131 and electron-emissive tip 116.

In general, the method of the invention for fabricating an FED includes the steps of forming a layer of dielectric material, forming an emitter-enhancing electrode on the layer of dielectric material, forming an enhanced-emission structure in the emitter-enhancing electrode, removing a portion of the layer of dielectric material proximate to the enhanced-emission structure to form a well, and forming an electron emitter within the well.

The example of the method of the invention, described with reference to FIGS. 3–9, is useful for fabricating FED's in which the shape of the opening defined by the emitter-enhancing electrode differs from the shape of the cross-section of the electron emitter. This method enables the formation of an electron emitter that does not have protruding edges, even though the distal edge of the emitter-enhancing electrode defines or partially defines, together with the enhanced-emission structure, an angle.

Cathode plate 110 of FIG. 3 is a structure realized by performing the steps of a preferred example of the method for fabricating an FED, in accordance with the invention. In the embodiment of FIG. 3, distal edge 119 of emitter-enhancing electrode 117 forms an angle 128 with enhanced-emission structure 131. In another example of the method of the invention, a structure can be realized in which an angle is defined by the distal edge alone. As illustrated in FIG. 3, the shape of the cross-section of electron emitter 115 is circular, while the shape of opening 121 is non-circular.

This configuration is in contrast to that of the prior art in which typically the electrode proximate to the electron emitter defines an opening that has the same shape as the cross-section of the electron emitter. This relationship between the shapes is due to the fact that the deposition of the electron emitter is typically performed through the opening defined by the proximate electrode.

If the method of the prior art were employed using a proximate electrode, which had a distal edge that defined an angle, such as that illustrated in FIG. 3, the resulting electron emitter would define sharp edges. These sharp edges would emit during the display mode of operation, and much of the emission current from the edges would probably be collected at the proximate electrode, resulting in inefficient operation of the FED.

The method of the invention overcomes these deficiencies of the prior art. The method of the invention also allows for the formation of many shapes for the opening of the emitter-enhancing electrode, which can be useful for forming enhanced emission structures.

Figure 4:
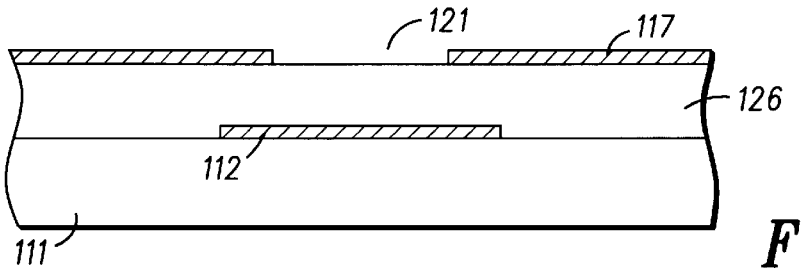
FIG. 4 is a cross-sectional view of a structure realized after the step of forming an emitter-enhancing electrode, in accordance with the method of the invention for fabricating a field emission device.

FIG. 4 is a cross-sectional view of a structure realized after the step of forming emitter-enhancing electrode 117, in accordance with the method of the invention for fabricating FED 100. To fabricate the structure of FIG. 4, first a layer 126 of dielectric material is formed on cathode 112. Thereafter, emitter-enhancing electrode 117 is formed on layer 126, using a convenient deposition technique. Emitter-enhancing electrode 117 can be made from an electron-emissive material, such as molybdenum or an emissive form of carbon. Further, the electron-emissive material is patterned to define opening 121.

Figure 5:
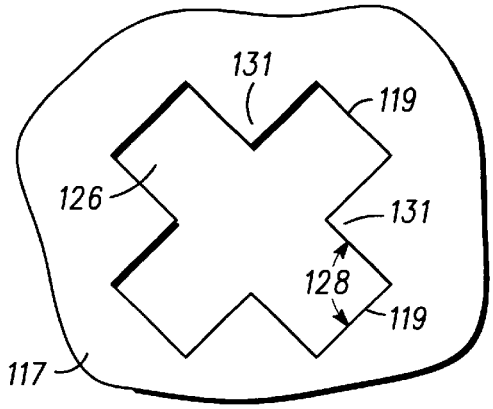
FIG. 5 is a top plan view of the structure in FIG. 4.

FIG. 5 is a top plan view of the structure of FIG. 4. As illustrated in FIG. 5, emitter-enhancing electrode 117 is patterned to form enhanced-emission structures 131. In the embodiment of FIG. 5, enhanced-emission structures 131 are patterned portions of emitter-enhancing electrode 117 that define sharp points.

Figure 6:
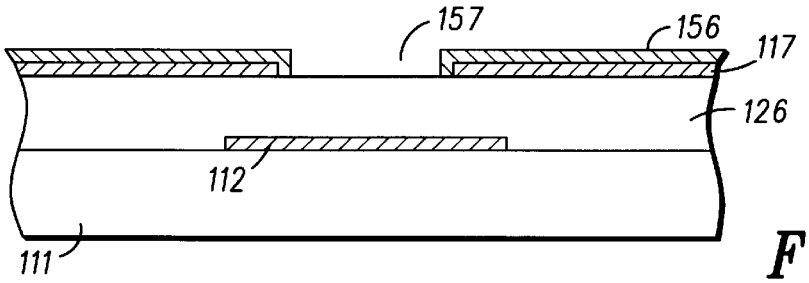
FIG. 6 is a cross-sectional view of a structure realized after the step of forming a mask layer on the emitter-enhancing electrode, in accordance with the method of the invention for fabricating a field emission device.

FIG. 6 is a cross-sectional view of a structure realized after the step of forming a mask layer 156 on emitter-enhancing electrode 117 of FIGS. 4 and 5, in accordance with the method of the invention for fabricating an FED. As illustrated in FIG. 6, mask layer 156 defines an opening 157, which is useful for defining the cross-section of electron emitter 115. Opening 157 is disposed within opening 121 of emitter-enhancing electrode 117.

Figure 7:
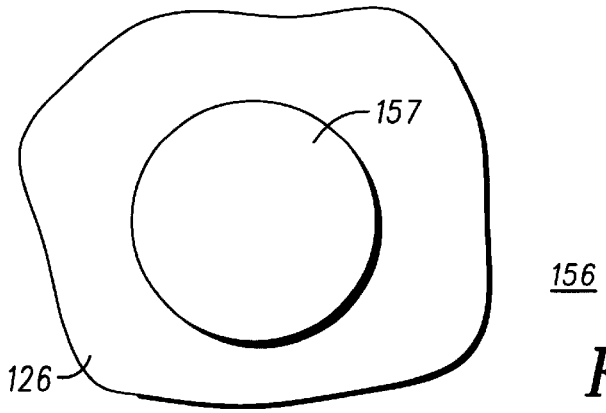
FIG. 7 is a top plan view of the structure in FIG. 6.

FIG. 7 is a top plan view of the structure of FIG. 6. As illustrated in FIG. 7, opening 157 of mask layer 156 is circular, which is useful for forming a conical electron emitter.

Figure 8:
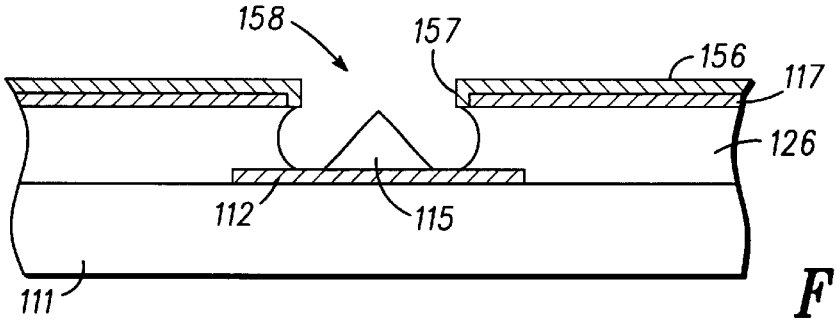
FIG. 8 is a cross-sectional view of a structure realized after performing upon the structure of FIG. 6 the steps of forming a deposition well and forming an electron emitter, in accordance with the method of the invention for fabricating a field emission device.

FIG. 8 is a cross-sectional view of a structure realized after performing upon the structure of FIG. 6 the steps of forming a deposition well 158 and forming electron emitter 115, in accordance with the method of the invention for fabricating an FED. In general, the method of the invention requires the steps of removing a portion of a layer of dielectric material proximate to the enhanced-emission structure to form a well and forming an electron emitter within the well. In the example of FIG. 8, the step of removing a portion of a layer of dielectric material includes the step of etching layer 126 through opening 157 of mask layer 156, thereby forming deposition well 158. Thereafter, an electron-emissive material is deposited through opening 157 of mask layer 156, to form a Spindt tip.

Figure 9:
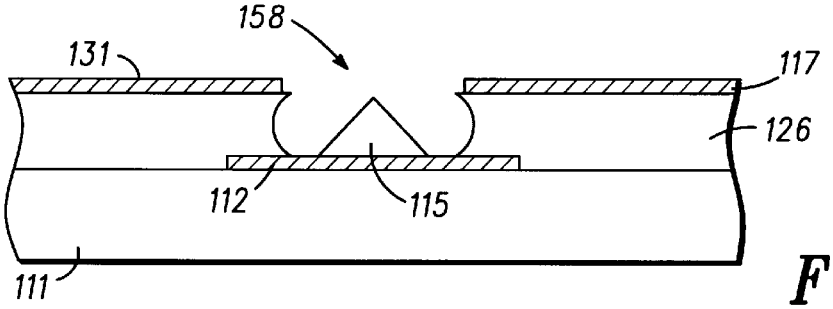
FIG. 9 is a cross-sectional view of a structure realized after performing upon the structure of FIG. 8 the step of removing the mask layer.

FIG. 9 is a cross-sectional view of a structure realized after performing upon the structure of FIG. 8 the step of removing mask layer 156. As illustrated in FIG. 9, enhanced-emission structure 131 lies on layer 126. To improve electron emission from enhanced-emission structure 131 during the conditioning mode of operation, layer 126 is removed from beneath enhanced-emission structure 131, thereby forming emitter well 114 and realizing the configuration illustrated in FIG. 1.

Figure 10:
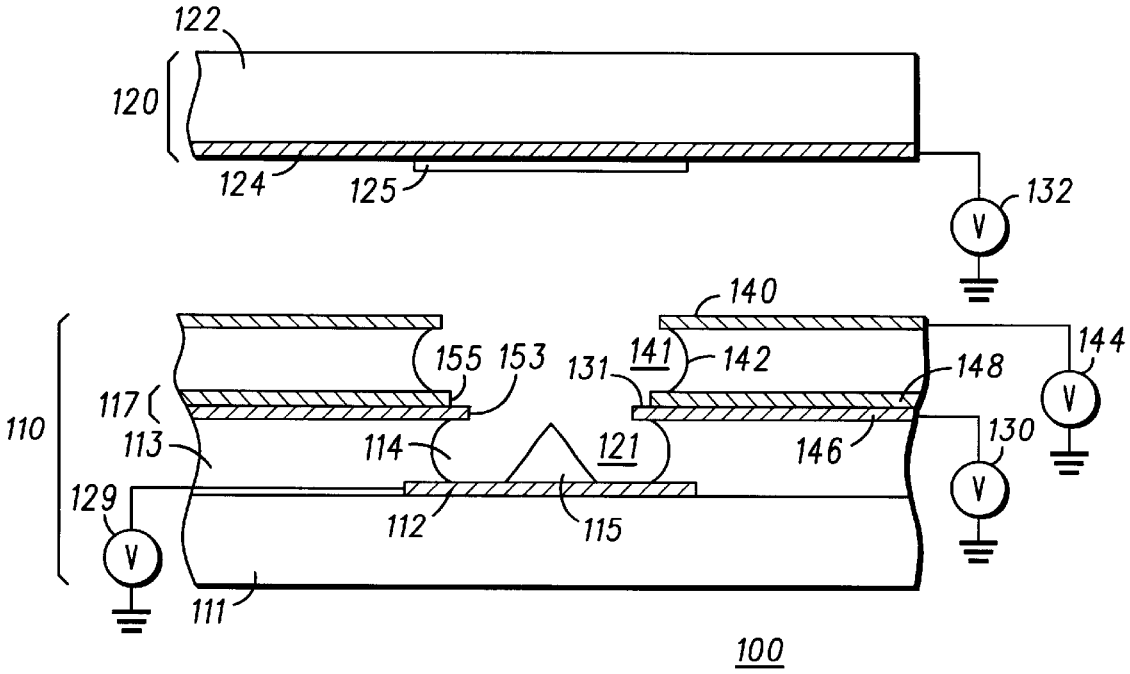
FIG. 10 is a cross-sectional view illustrating another embodiment of a field emission device made in accordance with the method of the invention.

FIG. 10 is a cross-sectional view illustrating another embodiment of FED 100 made in accordance with the method of the invention. In the embodiment of FIG. 10, emitter-enhancing electrode 117 includes an electron-emissive layer 146 and a second layer 148. Electron-emissive layer 146 is preferably made from an electron-emissive material, such as molybdenum, diamond, and the like. Second layer 148 is disposed on electron-emissive layer 146 and can be a conductive or nonconductive material. If second layer 148 is non-conductive, second voltage source 130 can be connected to electron-emissive layer 146. Second layer 148 further has an edge 155 that is pulled back from an edge 153 of electron-emissive layer 146.

Preferably, to enhance electron emission from emitter-enhancing electrode 117, electron-emissive layer 146 is thin and preferably has a thickness of less than 500 angstroms. Thus, in the embodiment of FIG. 10, the very thin edge 153 of electron-emissive layer 146 defines enhanced-emission structure 131. Edge 153 provides a sharp geometric feature for enhancing the local electric field during the conditioning mode of operation of FED 100. In general, however, the method of the invention for operating an FED can be performed on an FED, having the general configuration illustrated in FIG. 10, in which the enhanced-emission structure is any one of the enhanced-emission structures described with reference to the FIGS.

In contrast to the embodiment of FIG. 1, the embodiment of FIG. 10 further includes a gate extraction electrode 140 that is distinct from emitter-enhancing electrode 117. That is, gate extraction electrode 140 is useful for causing electron emission from electron emitter 115, and emitter-enhancing electrode 117 is useful for emitting electrons during the conditioning mode of operation of FED 100 of FIG. 10.

Gate extraction electrode 140 is made from a conductive material, which need not be electron-emissive, and is separated from emitter-enhancing electrode 117 by a second dielectric layer 142. Gate extraction electrode 140 is connected to a fourth voltage source 144 and defines an opening 141, which is in registration with opening 121 of emitter-enhancing electrode 117.

If second layer 148 is conductive, it can be useful for improving the electrical current through emitter-enhancing electrode 117 during the conditioning mode of operation of FED 100. Additionally, second layer 148, whether conductive or non-conductive, can provide favorable mechanical properties to emitter-enhancing electrode 117. For example, second layer 148 can be useful for maintaining the structural integrity of enhanced-emission structure 131 during the formation of electron emitter 115 and second dielectric layer 142.

Figure 11:
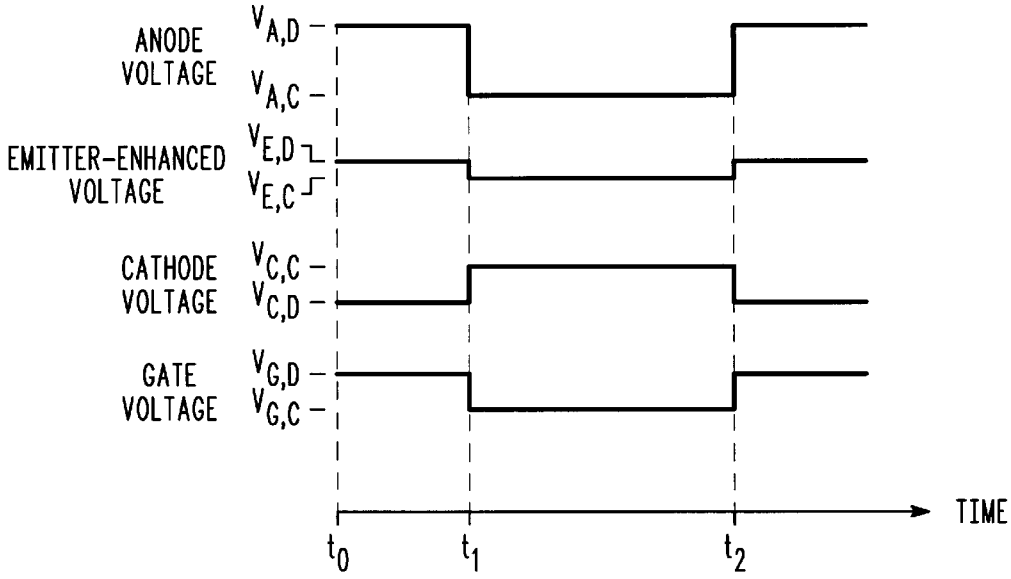
FIG. 11 is a timing diagram illustrating a method for operating the field emission device of FIG. 10, in accordance with the method of the invention for operating a field emission device.

FIG. 11 is a timing diagram illustrating a method for operating FED 100 of FIG. 10, in accordance with the method of the invention for operating an FED. Represented in FIG. 11 are the anode voltage, $V_A$, which is applied to anode 124; the emitter-enhancer voltage, $V_E$, which is applied to emitter-enhancing electrode 117; the cathode voltage, $V_C$, which is applied to cathode 112 and electron emitter 115; and the gate voltage, $V_G$, which is applied to gate extraction electrode 140.

The display mode of operation is represented in FIG. 11 by the portions of the graphs between times $t_0$ and $t_1$ and after time $t_2$. The conditioning mode of operation is represented in FIG. 11 by the portions of the graphs between times $t_1$ and $t_2$. In accordance with the method of the invention, during the display mode of operation, electron emitter 115 is caused to emit electrons, and, during the conditioning mode of operation, emitter-enhancing electrode 117 is caused to emit electrons. However, in contrast to the operation of the embodiment of FIG. 1, during the display mode of operation of the embodiment of FIG. 10, emitter-enhancing electrode 117 can also be caused to emit electrons.

During the display mode of operation of the embodiment of FIG. 10, the emitter-enhancer voltage, $V_{E,D}$, the anode voltage, $V_{A,D}$, the cathode voltage, $V_{C,D}$, and the gate voltage, $V_{G,D}$, are selected to cause electron emission from at least electron emitter 115 and to attract the electrons toward anode 124. As illustrated in FIG. 11, preferably, $V_{C,D}$ is maintained at about ground potential, $V_{A,D}$ is equal to a voltage within a range of 1000–5000 volts, $V_{G,D}$ is equal to about 100 volts, and the value of $V_{E,D}$ is intermediate the values of $V_{C,D}$ and $V_{G,D}$.

During the conditioning mode of operation, and in accordance with the method of the invention, the emitter-enhancer voltage, $V_{E,D}$, the anode voltage, $V_{A,D}$, the cathode voltage, $V_{C,D}$, and the gate voltage, $V_{G,D}$, are selected to cause electron emission from emitter-enhancing electrode 117 and to attract the electrons toward electron emitter 115. Thus, during the conditioning mode of operation, emitter-enhancing electrode 117 does not function as an extraction electrode for extracting electrons from electron emitter 115. Rather, emitter-enhancing electrode 117 is caused to emit electrons toward electron-emissive tip 116 of electron emitter 115.

This is achieved by applying to emitter-enhancing electrode 117 a potential, which is sufficiently less than the potential at electron emitter 115 to cause emitter-enhancing electrode 117 to emit electrons. Further during the conditioning mode of operation of FED 100, the potentials at anode 124 and gate extraction electrode 140 can be reduced to values that are sufficient to prevent attraction toward anode 124 and gate extraction electrode 140 of the electrons, which are emitted by emitter-enhancing electrode 117. As illustrated in FIG. 11, preferably, during the conditioning mode of operation of the embodiment of FIG. 10, $V_{E,C}$ is equal to a voltage of about ground potential; $V_{A,C}$ is equal to a voltage of about ground potential; $V_{C,C}$ is equal to about 100 volts; and $V_{G,C}$ is equal to about ground potential.

Figure 12:
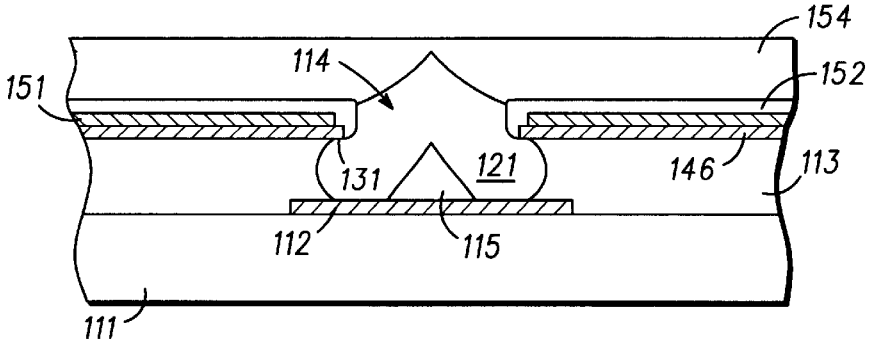
FIGS. 12 and 13 are cross-sectional views of structures realized during the fabrication of the field emission device of FIG. 10, in accordance with the method of the invention for fabricating a field emission device.
Figure 13:
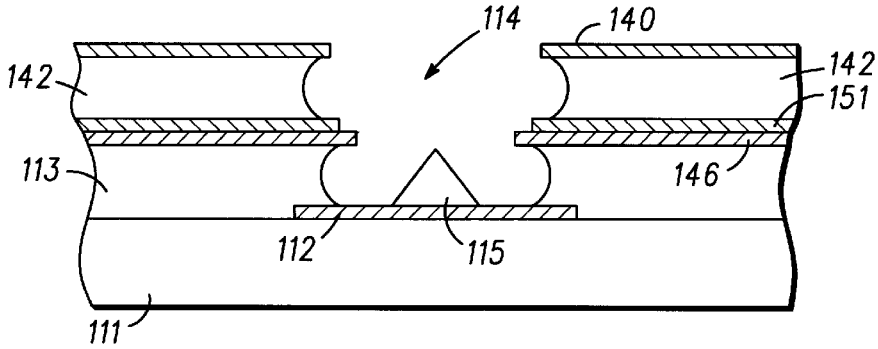

FIGS. 12 and 13 are cross-sectional views of structures realized during the fabrication of FED 100 of FIG. 10, in accordance with the method of the invention for fabricating an FED. The structure in FIG, 12 is realized by first forming a structure having a cross-sectional view, similar to that illustrated in FIG. 4. Layer 126 of dielectric material is formed on cathode 112. Then, a layer of the electron-emissive material for electron-emissive layer 146 is deposited on layer 126. A layer of the conductive or non-conductive material for second layer 148 is deposited on the layer of the electron-emissive material.

These two layers on layer 126 are then etched to have the same pattern, thereby forming electron-emissive layer 146 and a protective layer 151, which overlies electron-emissive layer 146. In particular, protective layer 151 overlies enhanced-emission structure 131. Protective layer 151 and electron-emissive layer 146 retain this overlapping configuration throughout the subsequent steps for forming electron emitter 115 (FIG. 12) and for forming second dielectric layer 142 and gate extraction electrode 140 (FIG. 13). Electron-emissive layer 146 and protective layer 151 further define opening 121.

Protective layer 151 is useful for maintaining the structural integrity of enhanced-emission structure 131 during the subsequent steps of the fabrication method. Protective layer 151 extends beyond enhanced-emission structure 131 a distance, which is selected to aid in maintaining the structural integrity of enhanced-emission structure 131. Subsequent to the formation of electron-emissive layer 146 and protective layer 151, layer 126 of dielectric material is etched through opening 121, thereby forming emitter well 114. Subsequent to the formation of emitter well 114, electron emitter 115 is formed.

As indicated by FIG. 12, protective layer 151 is useful for maintaining the mechanical integrity of enhanced-emission structure 131 while a lift-off layer 152 and a layer 154 of emitter material are deposited on protective layer 151 for forming electron emitter 115. After the step of forming electron emitter 115 within emitter well 114, lift-off layer 152 is removed, thereby also removing layer 154.

The structure of FIG. 13 is then realized by first performing the step of depositing on protective layer 151 a layer of the dielectric material for second dielectric layer 142. Gate extraction electrode 140 is formed on this dielectric layer. Then, the dielectric material is partially etched to form second dielectric layer 142 and expose electron emitter 115.

In accordance with the method of the invention, after second dielectric layer 142 is formed, protective layer 151 is removed from enhanced-emission structure 131. That is, protective layer 151 is partially etched back to expose enhanced-emission structure 131 and realize the configuration illustrated in FIG. 10.

In summary, the invention is for a method for operating a field emission device, which is useful for cleaning, conditioning, and sharpening the emissive surfaces of the electron emitters, while ameliorating the generation of contaminants from non-emissive surfaces. The method of operation of the invention includes the steps of causing an emitter-enhancing electrode to emit electrons and causing the electrons to be received by the electron emitter. The invention is further for a method for fabricating a field emission device, which is operated in accordance with the invention. The method for fabricating a field emission device includes the steps of forming an emitter-enhancing electrode and forming therein an enhanced-emission structure, which facilitates the electron emission from the emitter-enhancing electrode.

While we have shown and described specific embodiments of the present invention, further modifications and improvements will occur to those skilled in the art. For example, a method for operating an FED, in accordance with the invention, is not limited to operation of FED's having an emitter-enhancing electrode, which has an enhanced-emission structure. That is, the method of the invention can also be performed using prior art devices, which have a prior art gate extraction electrode proximate to the electron emitter. When the method of the invention is performed using a prior art device, the emitter-enhancing electrode is the prior art gate extraction electrode. As a further example, the step of forming an enhanced-emission structure can include the step of forming proximate to the electron emitter a tapered edge in the emitter-enhancing electrode, or the step of forming another structure, which enhances the local electric field at the emitter-enhancing electrode during the conditioning mode of operation.

We desire it to be understood, therefore, that this invention is not limited to the particular forms shown, and we intend in the appended claims to cover all modifications that do not depart from the spirit and scope of this invention.

What is claimed is:

1. A method for operating a field emission device having an electron emitter, the method comprising the steps of:

providing an emitter-enhancing electrode proximate to the electron emitter;

causing the emitter-enhancing electrode to emit electrons;

subsequent to the step of causing the emitter-enhancing electrode to emit electrons the step of causing the electron emitter to emit electrons;

concurrent with the step of causing the electron emitter to emit electrons the step of causing the emitter-enhancing electrode to emit electrons; and causing the electrons emitted by the emitter-enhancing electrode to be received by the electron emitter.

2. The method for operating a field emission device as claimed in claim 1, wherein the step of causing the electrons emitted by the emitter-enhancing electrode to be received by the electron emitter comprises the step of causing the electrons emitted by the emitter-enhancing electrode to be received by an electron-emissive tip of the electron emitter.

3. The method for operating a field emission device as claimed in claim 1, further comprising, prior to the step of causing the emitter-enhancing electrode to emit electrons, the step of causing the electron emitter to emit electrons, wherein the step of causing the electron emitter to emit electrons causes elevation of the temperature of the electron emitter to an elevated temperature, and wherein the step of causing the emitter-enhancing electrode to emit electrons comprises the step of causing the emitter-enhancing electrode to emit electrons while the temperature of the electron emitter is at the elevated temperature.

4. The method for operating a field emission device as claimed in claim 1, wherein the field emission device further has an anode, and further comprising the step of causing the electrons emitted by the electron emitter to be received by the anode.

5. A method for operating a field emission device having an electron emitter and an anode, the method comprising the steps of:

providing an emitter-enhancing electrode proximate to the electron emitter;

applying a first voltage to the anode comprising the step of applying a voltage of about ground potential to the anode, wherein the step of applying a second voltage to the emitter-enhancing electrode comprises the step of applying a voltage of about ground potential to the emitter-enhancing electrode, and wherein the step of applying a third voltage to the electron emitter comprises the step of applying a voltage of about 100 volts to the electron emitter;

concurrent with the step of applying a first voltage to the anode, applying a second voltage to the emitter-enhancing electrode (117); and concurrent with the step of applying a first voltage to the anode, applying a third voltage to the electron emitter, wherein the first voltage, the second voltage, and the third voltage are selected to cause electrons to be emitted by the emitter-enhancing electrode (117) and further selected to cause the electrons to be attracted toward the electron emitter.

6. The method for operating a field emission device as claimed in claim 5, further comprising the steps of:

providing a gate extraction electrode distinct from the emitter-enhancing electrode; and concurrent with the step of applying a first voltage to the anode, applying a fourth voltage to the gate extraction electrode, wherein the first voltage, the second voltage, the third voltage, and the fourth voltage are selected to cause electrons to be emitted by the emitter-enhancing electrode and further selected to cause the electrons to be attracted toward the electron emitter.

7. The method for operating a field emission device as claimed in claim 6, wherein the step of applying a fourth voltage to the gate extraction electrode comprises the step of applying a voltage of about ground potential to the gate extraction electrode.

8. A method for fabricating a field emission device comprising the steps of:

forming a layer of dielectric material;

forming an emitter-enhancing electrode on the layer of dielectric material;

forming an enhanced-emission structure in the emitter-enhancing electrode;

forming an electron emitter; and the step of forming an emitter-enhancing electrode comprises the step of forming an emitter-enhancing electrode, such that the emitter-enhancing electrode defines an opening having a first shape, and wherein the step of forming a mask layer on the emitter-enhancing electrode comprises the step of forming a mask layer, such that the mask layer defines within the opening defined by the emitter-enhancing electrode an opening having a second shape, such that the first shape is distinct from the second shape.

9. A method for fabricating a field emission device comprising the steps of:

forming an emitter-enhancing electrode, such that the emitter-enhancing electrode defines an opening having a first shape, and wherein the step of forming a mask layer on the emitter-enhancing electrode comprises the step of forming a mask layer, such that the mask layer defines within the opening defined by the emitter-enhancing electrode an opening having a second shape, such that the first shape is distinct from the second shape;

forming a mask layer on the emitter-enhancing electrode, such that the mask layer defines an opening disposed within the opening defined by the emitter-enhancing electrode;

depositing electron-emissive material through the opening defined by the mask layer, thereby forming an electron emitter; and thereafter, removing the mask layer.

10. The method for fabricating a field emission device as claimed in claim 9, further comprising the steps of:

prior to the step of forming an emitter-enhancing electrode, forming a layer of dielectric material, and wherein the step of forming an emitter-enhancing electrode comprises the step of forming an emitter-enhancing electrode on the layer of dielectric material;

subsequent to the step of forming a mask layer on the emitter-enhancing electrode, selectively etching the layer of dielectric material through the opening defined by the mask layer, thereby forming a deposition well, such that the electron emitter is formed in the deposition well during the step of depositing electron-emissive material.

11. The method for fabricating a field emission device as claimed in claim 9, wherein the step of forming an emitter-enhancing electrode comprises the step of forming an emitter-enhancing electrode, such that the emitter-enhancing electrode defines an opening having a non-circular shape, and wherein the step of forming a mask layer on the emitter-enhancing electrode comprises the step of forming a mask layer, such that the mask layer defines within the opening defined by the emitter-enhancing electrode an opening having a circular shape.

12. A method for fabricating a field emission device comprising the steps of:

forming a layer of dielectric material;

forming an electron-emissive layer on the layer of dielectric material, such that the electron-emissive layer defines an enhanced-emission structure;

forming a protective layer on the enhanced-emission structure, such that the protective layer extends a distance beyond the enhanced-emission structure, and such that the protective layer and the electron-emissive layer define an opening;

etching the layer of dielectric material through the opening defined by the protective layer and the electron-emissive layer, thereby forming an emitter well;

forming an electron emitter in the emitter well, wherein the distance through which the protective layer extends beyond the enhanced-emission structure is selected to maintain the structural integrity of the enhanced-emission structure during the step of forming the electron emitter; and removing the protective layer from the enhanced-emission structure.

13. The method for fabricating a field emission device as claimed in claim 12, wherein the step of forming an electron-emissive layer on the layer of dielectric material comprises the step of forming an electron-emissive layer having a thickness of less than 500 angstroms.

14. The method for fabricating a field emission device as claimed in claim 12, further comprising, subsequent to the step of forming an electron emitter and prior to the step of removing the protective layer from the enhanced-emission structure, the steps of:

forming a second dielectric layer on the protective layer; and forming a gate extraction electrode on the second dielectric layer.

15. The method for fabricating a field emission device as claimed in claim 12, wherein the step of forming a protective layer on the enhanced-emission structure comprises the step of forming a conductive layer on the enhanced-emission structure.

* * * * *